US005425783A

United States Patent [19]

Xie

[11] Patent Number: 5,425,783

[45] Date of Patent: Jun. 20, 1995

[54] TECHNIQUE OF TANNING SNAKE SKINS, AND A MATERIAL FOR PAINTING AND CALLIGRAPHY PRODUCED BY THE TECHNIQUE

[76] Inventor: Shaoyi Xie, Da Jiao Village, Yu Jiao Town, Jie Yang County, Guangdong Province, China

[21] Appl. No.: 41,418

[22] Filed: Mar. 31, 1993

[30] Foreign Application Priority Data

Mar. 31, 1992 [CN] China ..... 92102407.X
Mar. 11, 1993 [CN] China ..... 93102993.7

[51] Int. Cl.[6] ..... C14C 3/10; C14C 3/08

[52] U.S. Cl. ..... 8/94.32; 8/94.15; 8/94.18; 8/94.21; 8/94.33; 8/111

[58] Field of Search ..... 8/94.18, 94.15, 94.32, 8/94.33, 94.31, 94.21, 94.19, 111

[56] References Cited

U.S. PATENT DOCUMENTS

| | | | |
|---|---|---|---|
| 2,525,539 | 10/1950 | Gibson | 8/94.15 |
| 3,114,589 | 12/1963 | Bellucci-Sessa | 8/94.15 |
| 3,429,648 | 2/1969 | Langley | 8/94.15 |
| 4,731,089 | 3/1988 | Covington | 8/94.27 |
| 4,937,009 | 6/1990 | Covington | 8/94.26 |

OTHER PUBLICATIONS

Rao et al, *Leather Science*, 33(5), 1986, no month available, pp. 142–144.

Chemical Abstract #CA116(26):257765h, 1991, no month available.

Chemical Abstract #CA116(12):108715q, 1991, no month available.

41–Leather and Related Materials; Chemical Abstract 94:85685r p. 89, vol. 94, 1981, no month available.

45–Industrial Organics: Chemical Abstract 103:125346u p. 107, vol. 103, 1985, no month available.

45–Industrial Organics: Chemical Abstract 105:210735f p. 99, vol. 105, 1986, no month available.

45–Industrial Organics: Chemical Abstract 108:23632v p. 99, vol. 108, 1988, no month available.

*Primary Examiner*—Stephen Kalafut
*Assistant Examiner*—Alan D. Diamond
*Attorney, Agent, or Firm*—Birch, Stewart, Kolasch & Birch

[57] ABSTRACT

The invention relates to a technique of tanning snake skins and a material for painting and calligraphy produced from such snake skins processed by the technique, taking snake skins as raw material. The products obtained by means of this technique are of clean and white in nature and having unique liquid penetrant quality, so that perfect material from commercial angle for painting and calligraphy can be manufactured out of these skins.

5 Claims, No Drawings

TECHNIQUE OF TANNING SNAKE SKINS, AND A MATERIAL FOR PAINTING AND CALLIGRAPHY PRODUCED BY THE TECHNIQUE

The invention relates to a technique of tanning snake skins, and a material suitable for painting and calligraphy produced from such snake skins processed by the technique. More specifically, it relates to a manufacturing technique, through which tanned snake skins having good liquid penetrant quality can be obtained, so that a commercially acceptable material for painting and calligraphy can be manufactured from these skins.

It is noted that a kind of paper called Xuan paper is usually employed as material for traditional Chinese water-colour painting and calligraphy. This material is clean and white, fine-grained and closely textured, and has a unique liquid penetrant quality, so that it enjoys wide and great popularity among painting and calligraphy lovers. However, as it is apt to tear, great care must be taken during manufacturing it to prevent from becoming wastes. The rate of finished products is very low, a long-standing problem to the manufacturers. Further, painting or writing must be done without mistakes, because, a faulty stroke will lead to the entire work of art being turned into a scrap of waste paper. No doubt this is undesirable to famous masters or to beginners.

For many years, manufacturers have attempted to find out a substitute material to overcome the above-mentioned shortcomings, on the one hand, and to solve problems in packing and transportation on the other. However, such material has so far not yet been found.

It is significant at present to obtain a new material for painting and calligraphy through the technology of the present invention. Snake skin is taken as raw material, and after being processed by this technology, a new material for painting and calligraphy is obtained which is not only clean and white and having excellent liquid penetrant quality, but is not apt to be torn as well.

Moreover, the raw material used by the present invention comes chiefly from the skins of edible and artificially bred snakes. This resource is enormous and they are not killed only for the sake of getting their skins.

Furthermore, the tanned snake skins have typical characteristics. They can be effectively used in commercial advertisement or as wall paper. The images are most true to life, especially when animals or water ripples are depicted on this material for painting and calligraphy.

An object of the invention is therefore to provide a tanning technique for all kinds of snake skins.

A further object of the invention is to provide a material for painting and calligraphy produced from snake skins processed by said technique.

The snake skins to be tanned by the technology of the present invention might be raw or dried.

The technique of tanning snake skins of the present invention comprises the following steps;

(1) introducing into a rotary drum or other like device for treating skins a certain amount of water weighing 15–27 times the weight of the skins ready for processing and also sodium hydroxide weighing 1%–7% the weight of the skins;

(2) rotating the rotary drum for 1–30 minutes;

(3) introducing the skins into the rotary drum and leaving the contents therein undisturbed for 6–14 hours;

(4) discharging all the contents from the rotary drum;

(5) descaling the snake skins so treated;

(6) weighing the skins so treated;

(7) introducing into the rotary drum water weighing 5–7 times the weight of the skins weighed in step (6), and introducing into it one of the following substances, and rotating the rotary drum for 1–30 minutes;

a) hydrogen peroxide 30%–70% of the weight of the skins b) sodium hydrosulphite 2%–14% of the weight of the skins (8) introducing the skins into the rotary drum and leaving the contents therein undisturbed for 1.5–4 days;

(9) discharging the liquid from the rotary drum, and rinsing the contents in the drum to wash away the residual liquid;

(10) and once again introducing into the rotary drum water weighing 5–7 times the weight of the skins weighed in step (6), and introducing at the same time one of the following substances, then rotating the rotary drum for 1–30 minutes and leaving the contents therein undisturbed for another 1–30 minutes;

a) urea 6%–12% of the weight of the skins b) ammonium sulphate 8%–17% of the weight of the skins

(11) discharging the liquid from the rotary drum, and rinsing the contents in the drum to wash away the residual liquid;

(12) introducing into the rotary drum water weighing 5–7 times the weight of the skins weighed in step (6), and introducing at the same time furfurol weighing 6%–12% the weight of the skins, then rotating the rotary drum for 1–30 minutes and leaving the contents therein undisturbed for 2–4 hours;

(13) discharging the liquid from the rotary drum, and rinsing the contents in the drum to wash away the residual liquid;

(14) introducing into the rotary drum water weighing 5–7 times the weight of the skins weighed in step (6), and introducing at the same time salt weighing 20%–30% the weight of the skins, then rotating the rotary drum for 1–30 minutes and leaving the contents therein undisturbed for 1–30 minutes;

(15) also introducing into the rotary drum acetic acid weighing 8%–14% the weight of the skins, rotating the rotary drum for 1–30 minutes and leaving the contents therein undisturbed for 1–2 hours;

(16) discharging the liquid from the rotary drum, and rinsing the contents in the drum to wash away the residual liquid;

(17) introducing into the rotary drum water weighing 5–7 times the weight of the skins weighed in step (6), and introducing at the same time tannin of 1.5–2 degrees Bé (Baumé) weighing 30%–60% the weight of the skins, then rotating the rotary drum for 1–30 minutes and leaving the contents therein undisturbed for 0.5–2 days;

(18) discharging the liquid from the rotary drum;

(19) introducing once again into the rotary drum water weighing 5–7 times the weight of the skins weighed in step (6), and introducing at the same time tannin of 2.5–3 degrees Bé weighing 30%–60% the weight of the skins, then rotating the rotary drum for 1–30 minutes and leaving the contents therein undisturbed for 0.5–2 days;

(20) discharging the liquid from the rotary drum;

(21) introducing into the rotary drum water weighing 5–7 times the weight of the skins weighed in step (6), and also introducing at the same time tannin of 5–6 degrees Bé weighing 30%–60% the weight of the skins, then rotating the rotary drum for 1–30 minutes and leaving the contents therein undisturbed for 2–4 days;

(22) discharging from the rotary drum the whole contents;

(23) drying in air the skins obtained from step (22).

In this way, a desirable product is obtained. After trimming off the uneven portions on both sides, the snake skin is spread over a piece of rubberized paper or mounting tissue, and then levelled out by a thermocompressor, a finished product is obtained.

It is of advantage that step (1) is carried out in lukewarm water of 30° C.–60° C., weighing 20 times the weight of the skins ready for processing, and sodium hydroxide used in that step weighs preferably 5% of the weight of the skins ready for processing, and the time for leaving the contents undisturbed in step (3) is preferably 8 hours.

Step (7) is preferably carried out in lukewarm water of 30° C.–60° C. and the most desirable time for leaving the contents undisturbed in step (8) is 2 days.

Moreover, steps (17) and (19) are preferably carried out in lukewarm water of 30° C.–60° C., and their optimum time for leaving the contents undisturbed is 0.5 day.

Furthermore, step (21) is likewise preferably carried out in lukewarm water of 30° C.–60° C., and the optimum time for leaving the contents undisturbed is 2 days.

The product obtained through the above-mentioned technique is likewise suitable for Chinese traditional painting and calligraphy, because it also has an excellent liquid penetrant quality and is clean and white in nature. In addition, as it is flexible and not apt to tear, it is easy to be amended when faulty strokes occur.

The above-mentioned amending method comprises first applying a layer of thinner over places faulty strokes occur and before drying up of the thinner, another layer of correction fluid of any kind is applied.

I claim:

1. A method of tanning snake skins, comprising the following steps:

(1) introducing into a rotary drum for treating skins an amount of water weighing 15–27 times the weight of the skins to be processed, and sodium hydroxide weighing 1%–7% the weight of the skins;

(2) rotating the rotary drum for 1–30 minutes;

(3) introducing the skins into the rotary drum and leaving the contents therein undisturbed for 6–14 hours;

(4) discharging all the contents from the rotary drum;

(5) descaling the snake skins;

(6) weighing the skins;

(7) introducing into the rotary drum water weighing 5–7 times the weight of the skins weighed in step (6), and introducing into said drum a substance selected from the group consisting of:

a) hydrogen peroxide at a concentration from 30%–70% of the weight of the skins in step (6), and b) sodium hydrosulphite at a concentration from 2%–14% of the weight of the skins in step (6), and rotating the rotary drum for 1–30 minutes;

(8) introducing into the rotary drum the skins and leaving the contents therein undisturbed for 1.5–4 days;

(9) discharging the liquid from the rotary drum, and rinsing the contents in the drum to wash away the residual liquid;

(10) introducing into the rotary drum water weighing 5–7 times the weight of the skins weighed in step (6), and introducing at the same time a substance selected from the group consisting of:

a) urea at a concentration from 6%–12% of the weight of the skins in step (6), and b) ammonium sulphate at a concentration from 8%–17% of the weight of the skins in step (6); then rotating the rotary drum for 1–30 minutes and leaving the contents therein undisturbed for another 1–30 minutes;

(11) discharging the liquid from the rotary drum, and rinsing the contents in the drum to wash away the residual liquid;

(12) introducing into the rotary drum water weighing 5–7 times the weight of the skins weighed in step (6), and introducing at the same time furfurol weighing 6%–12% the weight of the skins in step (6), then rotating the rotary drum for 1–30 minutes and leaving the contents therein undisturbed for 2–4 hours;

(13) discharging the liquid from the rotary drum, and rinsing the contents in the drum to wash away the residual liquid;

(14) introducing into the rotary drum water weighing 5–7 times the weight of the skins weighed in step (6), and introducing at the same time salt weighing 20%–30% the weight of the skins in step (6), then rotating the rotary drum for 1–30 minutes and leaving the contents therein undisturbed for 1–30 minutes;

(15) also introducing into the rotary drum acetic acid weighing 8%–14% the weight of the skins in step (6), then rotating the rotary drum for 1–30 minutes and leaving the contents therein undisturbed 1–2 hours;

(16) discharging the liquid from the rotary drum, and rinsing the contents in the drum to wash away the residual liquid;

(17) introducing into the rotary drum water weighing 5–7 times the weight of the skins weighed in step (6), and introducing at the same time tannin of 1.5–2 degrees Bé weighing 30%–60% the weight of the skins in step (6), then rotating the rotary drum for 1–30 minutes and leaving the contents therein undisturbed for 0.5–2 days;

(18) discharging the liquid from the rotary drum;

(19) introducing into the rotary drum water weighing 5–7 times the weight of the skins weighed in step (6), and introducing at the same time tannin of 2.5–3 degrees Bé weighing 30%–60% the weight of the skins in step (6), then rotating the rotary drum for 1–30 minutes and leaving the contents therein undisturbed for 0.5–2 days;

(20) discharging the liquid from the rotary drum;

(21) introducing into the rotary drum water weighing 5–7 times the weight of the skins weighed in step (6), and introducing at the same time tannin of 5–6 degrees Bé weighing 30%–60% the weight of the skins in step (6), then rotating the rotary drum for 1–30 minutes and leaving the contents therein undisturbed for 2–4 days;

(22) discharging from the rotary drum the whole contents; and

(23) drying in air the skins obtained from step (22).

2. A method of tanning snake skins as claimed in claim 1, wherein said step (1) is carried out in lukewarm water of 30° C.–60° C. weighing 20 times the weight of the skins to be processed, and the sodium hydroxide used in said step weighs 5% of the weight of the skins to be processed, and the time for leaving the contents undisturbed in step (3) is 8 hours.

3. A method of tanning snake skins as claimed in claim 1, wherein said step (7) is carried out in lukewarm water of 30° C.–60° C., and the time for leaving the contents undisturbed in step (8) is 2 days.

4. A method of tanning snake skins as claimed in claim 1, wherein said steps (17) and (19) are carried out in lukewarm water of 30° C.–60° C., and the time for leaving the contents undisturbed is 0.5 day.

5. A method of tanning snake skins as claimed in claim 1, wherein said step (21) is carried out in lukewarm water of 30° C.–60° C., and the time for leaving the contents undisturbed is 2 days.

* * * * *